US011252990B2

(12) United States Patent
Bray et al.

(10) Patent No.: US 11,252,990 B2
(45) **Date of Patent: *Feb. 22, 2022**

(54) APPARATUS AND METHOD FOR MANUFACTURING TOBACCO INDUSTRY PRODUCTS

(71) Applicant: British American Tobacco (Investments) Limited, London (GB)

(72) Inventors: Andrew Jonathan Bray, London (GB); Gerhard Le Roux, Paarl (ZA); Sam Whiffen, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 243 days.

This patent is subject to a terminal disclaimer.

(21) Appl. No.: 16/301,569

(22) PCT Filed: May 25, 2017

(86) PCT No.: PCT/GB2017/051474
§ 371 (c)(1),
(2) Date: Nov. 14, 2018

(87) PCT Pub. No.: WO2017/203255
PCT Pub. Date: Nov. 30, 2017

(65) Prior Publication Data

US 2019/0281886 A1 Sep. 19, 2019

(30) Foreign Application Priority Data

May 27, 2016 (GB) ..... 1609409

(51) Int. Cl.
*A24C 5/47* (2006.01)
*A24C 5/32* (2006.01)

(52) U.S. Cl.
CPC ..... *A24C 5/472* (2013.01); *A24C 5/327* (2013.01); *A24C 5/471* (2013.01)

(58) Field of Classification Search
CPC ..... A24C 5/327; A24C 5/472
(Continued)

(56) References Cited

U.S. PATENT DOCUMENTS 1,908,771 A 5/1933 Lied
2,840,164 A 6/1958 Rudszinat
(Continued)

FOREIGN PATENT DOCUMENTS

CH 486855 1/1967
DE 524532 4/1931
(Continued)

OTHER PUBLICATIONS

Machine Translation of DE 19718322 (Year: 1998).*
(Continued)

*Primary Examiner* — Eric Yaary
*Assistant Examiner* — Russell E Sparks
(74) *Attorney, Agent, or Firm* — Cantor Colburn LLP

(57) ABSTRACT

Embodiments disclosed herein relate to an apparatus (1) for manufacture of tobacco industry products (21). The apparatus (1) comprising a rolling unit (9) comprising: • a rotatable drum (14) having a plurality of recesses formed in an outer surface of the drum (14) to receive tobacco industry product components (5/6); • a roll hand (15) spaced from the outer surface of the drum (14) to define a space between the outer surface of the drum (14) and the roll hand (15), within which space tobacco industry product components (5/6) are rollable upon rotation of the drum (14); and • a kicker bar (16) disposed adjacent to the roll hand (15). • The kicker bar (16) is moveable relative to the roll hand (15) and in a direction towards and away from the drum (14) during
(Continued)

operation of the apparatus (1), and the kicker bar (16) is biased towards the drum (14).

11 Claims, 8 Drawing Sheets

(58) Field of Classification Search
USPC ..... 131/29
See application file for complete search history.

(56) References Cited

U.S. PATENT DOCUMENTS

| | | | | |
|---|---|---|---|---|
| 3,001,528 | A | 9/1961 | Schubert | |
| 3,176,694 | A | 4/1965 | Kaeding | |
| 3,228,512 | A | 1/1966 | Rudzinat | |
| 3,400,857 | A | 9/1968 | Schubert | |
| 3,478,632 | A | 11/1969 | Schmermund | |
| 4,020,852 | A * | 5/1977 | Baker | A24C 5/471 131/94 |
| 4,023,577 | A | 5/1977 | Preston | |
| 4,112,954 | A | 9/1978 | Preston | |
| 4,665,930 | A | 5/1987 | Arthur | |
| 4,827,947 | A | 5/1989 | Hinz | |
| 5,632,285 | A * | 5/1997 | Dahlgrun | A24C 5/471 131/94 |
| 5,984,851 | A | 11/1999 | Irikura | |
| 6,302,113 | B1 | 10/2001 | Ozeray | |
| 6,425,400 | B1 | 7/2002 | Krause | |
| 2015/0291301 | A1 | 10/2015 | Cadieux | |

FOREIGN PATENT DOCUMENTS

| | | | |
|---|---|---|---|
| DE | 1188495 | | 3/1965 |
| DE | 2254971 | | 5/1974 |
| DE | 2517299 | A1 | 11/1975 |
| DE | 3705627 | A1 | 9/1988 |
| DE | 19718322 | A1 | 11/1998 |
| DE | 102005019681 | A1 | 11/2006 |
| DE | 102011083029 | A1 | 10/2012 |
| DE | 102013201854 | A1 | 8/2014 |
| EP | 0395280 | A2 | 10/1990 |
| EP | 0687424 | A1 | 12/1995 |
| EP | 1493338 | A1 | 1/2005 |
| EP | 1629734 | A1 | 3/2006 |
| EP | 2762014 | A2 | 8/2014 |
| EP | 2813153 | A1 | 12/2014 |
| EP | 3315032 | A1 | 5/2018 |
| GB | 469815 | | 8/1937 |
| GB | 746435 | | 3/1956 |
| GB | 785417 | | 10/1957 |
| GB | 797632 | | 7/1958 |
| GB | 872629 | | 2/1960 |
| GB | 833998 | | 5/1960 |
| GB | 970050 | | 9/1964 |
| GB | 998958 | | 7/1965 |
| GB | 1020796 | | 2/1966 |
| GB | 1121069 | | 7/1968 |
| JP | 07256051 | A | 10/1995 |
| JP | 2013247954 | A | 12/2013 |
| KR | 1020150111355 | A | 10/2015 |
| WO | 9960874 | A1 | 12/1999 |
| WO | 2013146528 | A1 | 10/2013 |
| WO | 2014118309 | A1 | 8/2014 |

OTHER PUBLICATIONS

International Preliminary Report of Patentability for corresponding application PCT/GB2017/051474 filed May 25, 2017 dated Sep. 6, 2018.

International Preliminary Report on Patentability for corresponding application PCT/GB2017/051449 filed May 24, 2017; Report dated Sep. 6, 2018.

International Preliminary Report on Patentability for corresponding application PCT/GB2017/051477 filed May 25, 2017; dated Sep. 6, 2018.

International Search Report for corresponding application PCT/GB2017/051177 filed Apr. 27, 2017; dated Jul. 14, 2017.

International Search Report for corresponding application PCT/GB2017/051449 filed May 24, 2017; dated Aug. 7, 2017.

International Search Report for corresponding application PCT/GB2017/051474 filed May 25, 2017; dated Aug. 9, 2017.

International Search Report for corresponding application PCT/GB2017/051477 filed May 25, 2017; dated Aug. 10, 2017.

Written Opinion of the International Search Authority for corresponding application PCT/GB2017/051177 filed Apr. 27, 2017; dated Jul. 14, 2017.

Written Opinion of the International Searching Authority for corresponding application PCT/GB2017/051449 filed May 24, 2017; dated Aug. 7, 2017.

Written Opinion of the International Searching Authority for corresponding application PCT/GB2017/051474 filed May 25, 2017; dated Aug. 9, 2017.

Written Opinion of the International Searching Authority for corresponding application PCT/GB2017/051477 filed May 25, 2017; dated Aug. 10, 2017.

* cited by examiner

APPARATUS AND METHOD FOR MANUFACTURING TOBACCO INDUSTRY PRODUCTS

TECHNICAL FIELD

Embodiments of the invention relate to an apparatus for manufacturing tobacco industry products, and to a method of use of such apparatus in the manufacture of tobacco industry products.

BACKGROUND

It is known to provide apparatuses for receiving, arranging and assembling components for the manufacture of tobacco industry products, such as smoking articles. Such apparatuses can include a series of drums that convey components along a manufacturing path as the drums rotate. Components are transferred from one drum to the next at a point where the circumferential surfaces of the drums are closest to each other. As the components are conveyed along the path they are subject to several processes, for example cutting, sliding, combining with other components, gluing, and rolling or wrapping with a paper patch. Cigarette components typically include filters, filter components and wrapped tobacco rods.

SUMMARY

In accordance with some embodiments described herein, there is provided an apparatus for manufacture of tobacco industry products, the apparatus comprising a rolling unit comprising:

- a rotatable drum having a plurality of recesses formed in an outer surface of the drum to receive tobacco industry product components;
- a roll hand spaced from the outer surface of the drum to define a space between the outer surface of the drum and the roll hand, within which space tobacco industry product components are rollable upon rotation of the drum; and
- a kicker bar disposed adjacent to the roll hand;
- wherein the kicker bar is moveable relative to the roll hand and in a direction towards and away from the drum during operation of the apparatus; and
- wherein the kicker bar is biased towards the drum.

In some embodiments, the kicker bar is deflectable away from the drum by contact with tobacco industry product components received in the drum recesses during rotation of the drum.

In some embodiments the kicker bar is coupled to the roll hand.

The kicker bar may be moveable between an extended position in which a contact edge of the kicker bar is spaced from the drum by a first distance, and a deflected position in which the kicker bar is spaced from the drum by a second distance greater than the first distance. The kicker bar may be biased into the extended position.

The roll hand may comprise a curved contact surface facing the drum, and wherein the contact edge of the kicker bar may be disposed closer to the drum than the contact surface of the roll hand in at least the extended position of the kicker bar.

In some embodiments, the position of the kicker bar relative to the roll hand in the extended position is adjustable In some embodiments, the kicker bar is connected to a mounting mechanism which is configured to enable the kicker bar to move towards and away from the rolling drum.

The mounting mechanism may comprise a biasing mechanism configured to bias the kicker bar towards the drum.

The biasing mechanism may be adjustable such that biasing force with which the kicker bar is biased towards the drum is adjustable.

The biasing mechanism may comprise a spring, and the pre-load of the spring may be adjustable In one embodiment, the kicker bar is moveable linearly towards and away from the drum. In another embodiment, the kicker bar is pivotable towards and away from the drum.

In accordance with some embodiments described herein, there is also provided a tobacco industry product assembly machine comprising an apparatus as described above.

In accordance with some embodiments described herein, there is also provided a method of manufacturing tobacco industry products, comprising use of apparatus for manufacturing tobacco industry products, the apparatus comprising a rolling unit including a rotatable drum having a plurality of recesses formed in an outer surface of the drum, a roll hand spaced from the outer surface of the rolling drum to define a space between the outer surface of the drum and the roll hand, within which space tobacco industry product components are rollable upon rotation of the drum, and a kicker bar disposed adjacent to the roll hand, the method comprising transferring a plurality of tobacco industry product components into the recesses formed in the outer surface of the drum, rotating the drum relative to the kicker bar so that the tobacco industry product components engage the kicker bar, and the kicker bar moving away from the drum against a biasing force to accommodate the tobacco industry product components.

In some embodiments, the kicker bar is deflected away from the drum from an extended position in which a contact edge of the kicker bar is spaced from the drum by a first distance, to a deflected position in which the kicker bar is spaced from the drum by a second distance greater than the first distance.

In some embodiments the method may comprises adjusting the position of the kicker bar relative to the roll hand in the extended position.

In some embodiments, the kicker bar is connected to a mounting mechanism comprising a biasing mechanism configured to bias the kicker bar towards the drum, and the method may comprise adjusting the biasing mechanism to adjust the biasing force with which the kicker bar is biased towards the drum.

The biasing mechanism may comprise a spring, and adjusting the biasing mechanism to adjust the biasing force may comprise adjusting the pre-load of the spring.

BRIEF DESCRIPTION OF THE DRAWINGS

Embodiments of the invention will now be described, by way of example only, with reference to the accompanying drawings in which.

DETAILED DESCRIPTION

Figure 1:
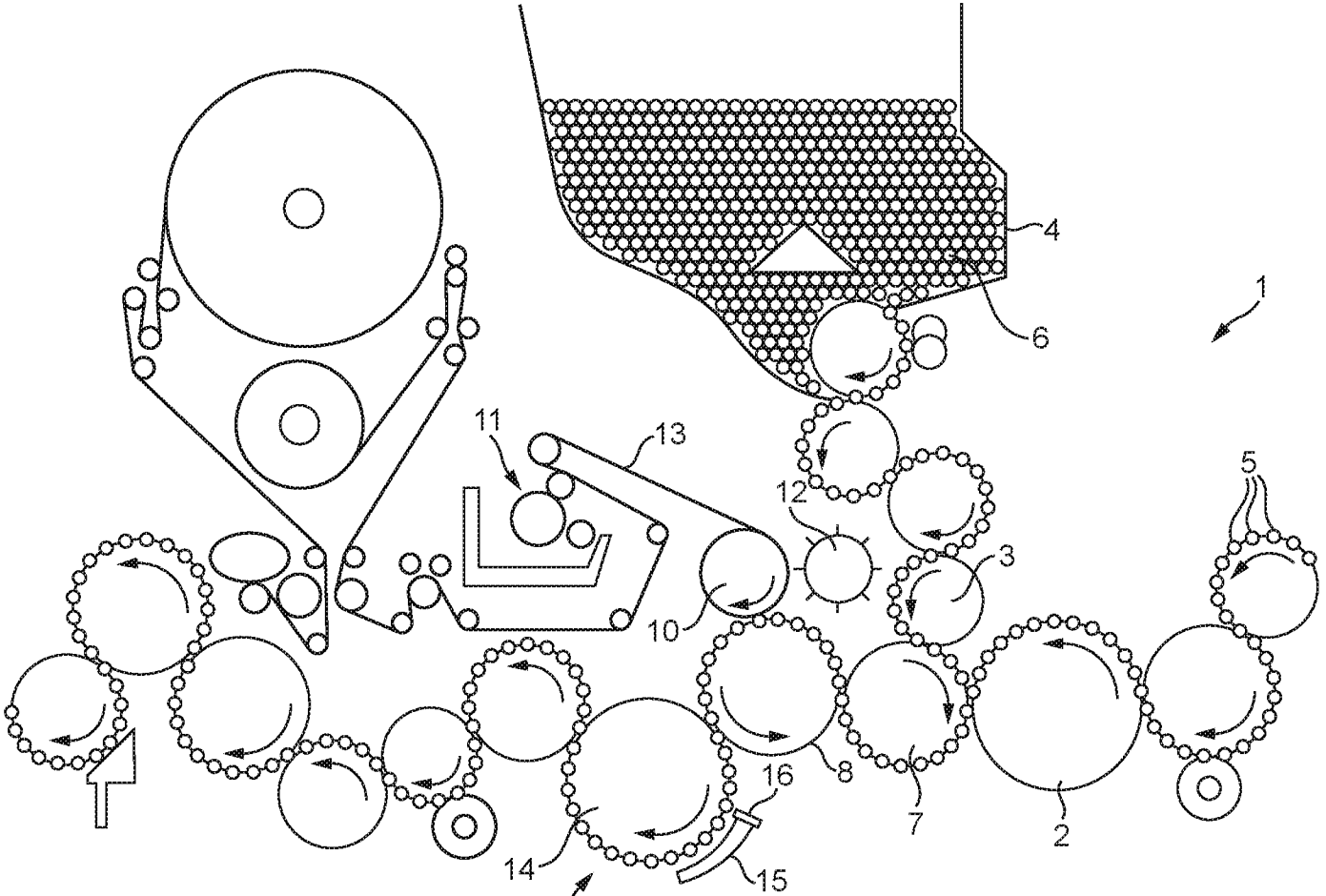
FIG. 1 shows a schematic illustration of a tobacco industry product manufacturing apparatus comprising an embodiment of the invention.

FIG. 1 schematically shows a part of a tobacco industry product manufacturing apparatus 1 comprising a tobacco industry product manufacturing apparatus of one embodiment of the present invention. Hereafter, the description will refer to such tobacco industry products as "smoking articles" for brevity. The apparatus 1 includes a tobacco rod feed drum 2 and a filter component feed drum 3. The tobacco rod feed drum 2 receives wrapped tobacco rods 5 that are travelling in a direction transverse to their length (i.e. sideways) in flutes formed in the peripheral surface of the tobacco rod feed drum 2. The filter component feed drum 3 receives filter components 6 from a hopper 4 in flutes formed in the peripheral surface of the filter component feed drum 3. In the apparatus 1 shown, a single filter component feed drum 3 and single hopper 4 is shown. However, the apparatus may include multiple filter component feed drums 3 and/or multiple hoppers 4, in order that different configurations or types of filter components may be combined and assembled into smoking articles being manufactured. Alternatively, the single hopper 4 may be configured to provide different configurations of filter components 6 to the filter component feed drum 3.

The filter component feed drum 3 and the tobacco rod feed drum 2 feed filter components 6 and tobacco rods 5, respectively, onto a combining drum 7, such that the filter components 6 and tobacco rods 5 are axially aligned in flutes on the peripheral surface of the combining drum 7, ready to be wrapped to form an assembled smoking article.

As shown in FIG. 1, from the combining drum 7 the tobacco rods 5 and filter components 6 are transferred onto a tipping drum 8 where they are provided with a tipping paper patch 22 (see FIG. 2) before being transferred to a rolling unit 9 that rolls the tipping paper patch 22 around the tobacco rods 5 and filter components 6 to form two joined and assembled smoking articles 21 in back-to-back arrangement. The tipping paper patch is supplied to the tipping drum 7 by a tipping paper suction drum 10.

A web 13 of tipping paper passes through an adhesive applicator 11 that applies adhesive to one surface of the tipping paper web 13. The tipping paper web 13 is then received on the tipping paper suction drum 10, which uses suction to hold the web 13 of tipping paper against the peripheral surface of the tipping paper suction drum 10. A cutting unit 12 cuts the web 13 of tipping paper into patches on the tipping paper suction drum 10 and the patches are then transferred to the tobacco rods 5 and filter components 6 on the tipping drum 8.

In one example, the cutting unit 12 comprises a crush cutter. In this case, the cutting unit 12 comprises a rotary blade and the tipping paper suction drum 10 acts as an anvil against which the tipping paper web 13 is cut by the rotary blade, in a transverse direction (i.e. across the web 13), to form patches of tipping paper.

In an alternative embodiment, the cutting unit 12 uses a shear cutter to cut the web 13. In this case, the tipping paper suction drum 10 comprises edges that act with blades of the cutting unit 12 to shear cut the tipping paper web 13.

The cutting unit 12 may have several rotary blades which protrude from a shaft in a radial direction so that as the shaft rotates the blades successively engage the tipping paper suction drum 10 and cut the web 13 in a transverse direction (i.e. in the axial direction of the tipping paper suction drum 10 and cutting unit 12).

The cut patches of tipping paper 22 on the tipping paper suction drum 10 already have adhesive applied to their outwards facing surface, so at the position where the tipping paper suction drum 10 rotates closest to the tipping drum 8 the suction acting on the tipping paper patches 22 is released and the patches are transferred from the tipping paper suction drum 10 to the tipping drum 8, specifically onto the tobacco rods 5 and filter components 6. The adhesive anchors the tipping paper patches to the tobacco rods 5 and filter components 6.

The tipping drum 8 then transfers the tobacco rods 5 and filter components 6 and the tipping paper patch 22 into the rolling unit 9 that rolls the tipping paper patch 22 around the tobacco rods 5 and filter components 6 to form smoking articles. The rolling unit 9 comprises a rolling drum 14 that receives and carries the tobacco rods 5 and filter components 6 and the tipping paper patch 22 past a stationary roll hand 15 and moveable kicker bar 16 (described in more detail below).

Figure 3:
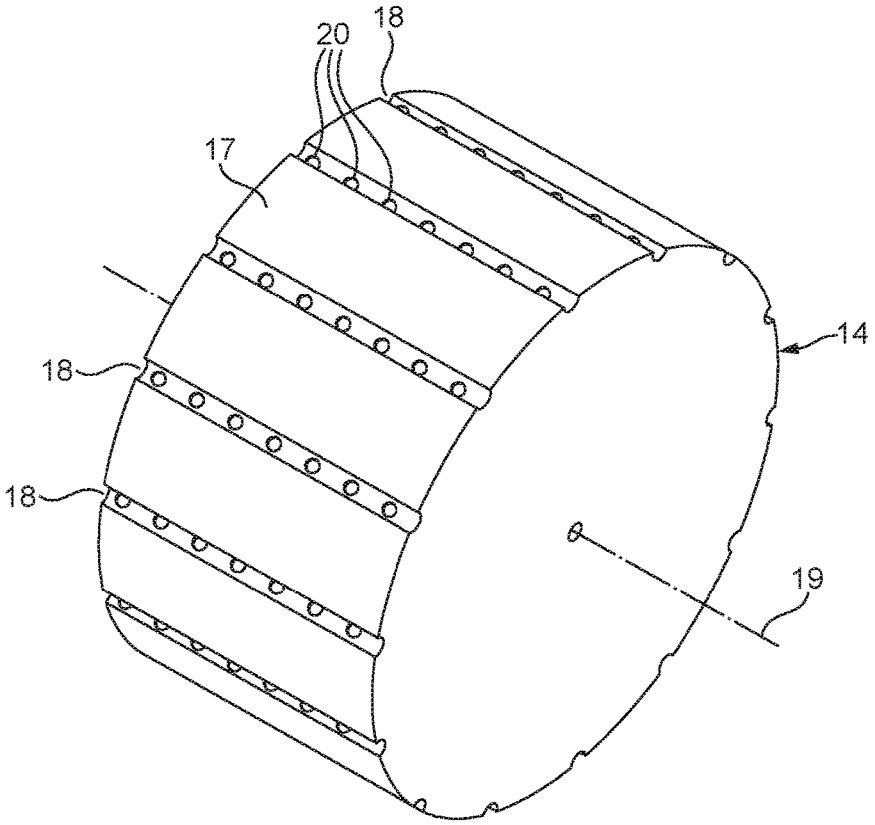
FIG. 3 shows a rolling drum of the tobacco industry product manufacturing apparatus of FIG. 1.

The rolling drum 14 is shown in more detail in FIG. 3, and comprises a cylindrical drum 14 having a curved outer surface 17 with a plurality of flutes 18 formed in the curved outer surface 17. The drum 14 is adapted to rotate about an axis 19. The flutes 18 are sized to receive and retain tobacco and/or filter components as the drum 14 rotates. The flutes 18 extend in a direction parallel to the axis of rotation 19 of the drum 14.

Each flute 18 includes at least one suction hole 20 that holds the components in the flute 18 when suction is provided to the suction hole 20. In this example, each flute 18 includes several suction holes 20, so that multiple components can be retained in the flute 18. However, multiple suction holes 20 may be provided to retain a single elongate component. Turning off the suction applied to the suction holes 20 will allow the components to leave the flute 18.

A suction manifold (not shown) can be used to provide suction to the suction holes 20 during pre-defined portions of the rotation of the drum 14, and to switch off the suction to the suction holes 20 in other pre-defined portions of the rotation of the drum 14.

The kicker bar 16 pushes the tobacco rods 5 and filter components 6 and the tipping paper patch 22 out of flutes 18 in the rolling drum 14 as the rolling drum 14 rotates them past the kicker bar 16. The tobacco rods 5 and filter components 6 and the tipping paper patch 22 are then rolled between the curved surface 17 of the rolling drum 14 and the roll hand 15, thereby wrapping the tipping paper patch 22 around the tobacco rods 5 and filter components 6 to join them together.

The rolled smoking articles are then conveyed by further drums for cutting into individual single length smoking articles, aligning, arranging and packaging.

Figure 2:
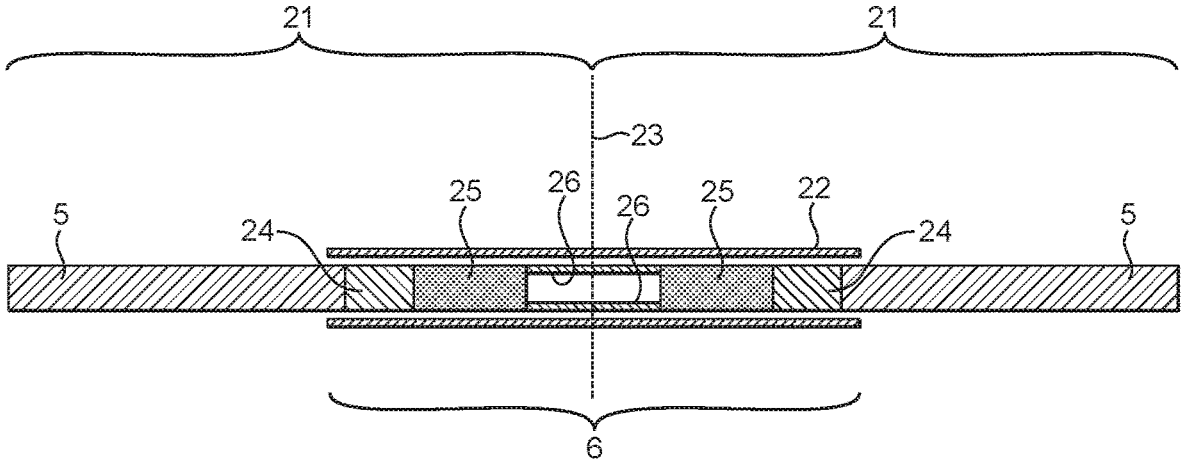
FIG. 2 shows a cross section of an example of a tobacco industry product manufactured by the apparatus of FIG. 1.

Referring to FIG. 2, two joined smoking articles 21 are manufactured together, as explained above, by arranging two tobacco rods 5 at either end of a double-length filter component 6 on the combining drum 7. The tobacco rods 5 and filter component 6 are joined together by wrapping a tipping paper patch 22 about them, and then cutting through the filter component 6 along line 23 to separate the two smoking articles 21.

The roll hand 15 and kicker bar 16 are mounted on a support mechanism 27. The support mechanism 27 is configured to hold the roll hand 15 in a fixed position during operation of the apparatus 1. In the exemplary embodiment shown, the support mechanism 27 comprises a bracket 28 fixedly secured to the roll hand 15 and mounted about a pivot point 29 to a fixed portion of the apparatus 1. A piston 30 is attached at one end to a portion of the bracket 28 and at the other end to a fixed portion of the apparatus 1. The piston 30 is provided to enable the roll hand 15 to be moved away from the rolling drum 14 for servicing or maintenance, but in use of the apparatus 1, holds the roll hand 15 in a fixed operative position (shown in FIG. 4). The roll hand 15 is thereby not moveable away from or towards the rolling drum 14 during operation of the apparatus 1.

As explained above, filter components 6, tobacco rods 5, tipping paper patches 22, and wrapped smoking articles 21, collectively 'components', are transferred between successive drums as the components travel through the apparatus 1 to manufacture smoking articles 21. The components 5, 6, 21, 22 are transferred from one drum to the next at the point where the peripheral surfaces of the drums are closest, and at these transfer points the components 5, 6, 21, 22 are in contact with the flutes of both drums.

The drums are arranged such that at each transfer point, the components 5, 6, 21, 22 are smoothly and reliably transferred. That is, the components 5, 6, 21, 22 are placed into the flutes of the downstream drum so that the suction applied in the flute can take effect on the components 5, 6, 21, 22 before the upstream drum moves away. During transfer, suction acts on the components 5, 6, 21, 22 from either the upstream drum, the downstream drum, or, for short time, both the upstream and downstream drums.

In the rolling unit 9, as the tobacco rods 5 and filter components 6 pass between the roll hand 15 and kicker bar 16, the kicker bar 16 initially engages the tobacco rods 5 and filter components 6, compressing them slightly to ensure they are reliably pushed out of their flute 18 in the rolling drum 14. As described above, as the rolling drum 14 continues to rotate, the tobacco rods 5 and filter components 6 are rolled between the rotating rolling drum 14 and the stationary roll hand 15 to become wrapped with the tipping paper patch 22. The spacing between the kicker bar 16 and the roll hand 15 and the curved surface 17 of the rolling drum 14 is accurately set to ensure the correct degree of initial compression of the tobacco rods 5 and filter components 6 in the flute 18, and correct contact pressure of the tobacco rods 5 and filter components 6 between the curved surface 17 of the rolling drum 14 and the roll hand 15. In a conventional tobacco industry product manufacturing apparatus, in which the tobacco rods 5 and filter components 6 are of a similarly equal resilience and compressibility, the kicker bar 16 and roll hand 15 are rigidly connected, or are formed as one component, and the kicker bar 16 remains fixed relative to the roll hand 15. The roll hand 15 conventionally comprises a continuous curved surface and the kicker bar comprises a continuous elongate bar.

In various examples within the scope of the invention, each filter component 6 may comprise one or more filter segments. For example, the filter rod 6 may be formed of any combination of cellulose acetate segments, plasticised cellulose acetate segments, paper segments, non-wrapped cellulose acetate segments, plastic components, ceramic components, or metallic segments. These filter segments are generally cylindrical and/or tubular, and may have a cylindrical outer surface that fits within the flutes of the drums and can be rolled by the rolling drum 14 to create a wrapped smoking article.

The filter segments may each have a wrapper, typically called a plug wrap, which holds the material of the filter segment in the desired shape before the filter segment is provided to the apparatus 1 of FIG. 1.

The smoking articles shown in FIG. 2 and made on the apparatus of FIG. 1 may be cigarettes. Alternatively, the smoking articles may be products which heat tobacco without burning that tobacco to release a vapour. Yet further, the smoking articles may be products of a device that heats tobacco without burning that tobacco to release a vapour. Alternatively, they may be any other kind of smoking article that is manufactured on apparatus having a series of drums.

In the exemplary embodiment, the smoking article shown in FIG. 2 comprises a wrapped tobacco rod 5 which comprises a tobacco material wrapped in a wrapper, for example a paper wrapper. The smoking article also comprises a filter component 6. In this example, the filter component 6 comprises a first filter segment 24 being made of plasticized cellulose acetate through which smoke or vapour can pass and which removes constituents from the smoke or vapour. A second segment 25 of the filter component 6 comprises a tubular member made from plastics, the plastics tubular member having passages therethrough to allow smoke or vapour to pass through the filter section. A third filter segment 26 comprises a tubular member made of paper.

As is apparent from FIG. 2, each filter component 6 supplied to the apparatus of FIG. 1 is symmetrical so that after the filter component 6 is cut along line 23 there are two identical smoking articles 21.

It will be appreciated that other filter sections have different combinations of components, and it is possible to arrange such components in a multitude of ways using drums that received, move and position components in the same flute so that they can be wrapped to join them into smoking articles.

The filter component 6 is attached to the end of a tobacco rod 5 by a tipping paper patch 22 that circumscribes the join between the filter component 6 and tobacco rod 5. The tipping paper patch 22 is adhered to the outer surface of the filter component 6 and the tobacco rod 5. The tipping paper patch 22 may extend over the whole of the filter component 6 and partially over the tobacco rod 5. Alternatively, the tipping paper patch 22 may extend partially onto the filter component 6 and partially onto the tobacco rod 5.

As explained above, the smoking articles manufactured by the apparatus 1 of FIG. 1 may include components or segments having a high hardness, for example components made of plastic, ceramic or metal. In this case, during the rolling process in the rolling unit 9, such components are placed under pressure, such as by the kicker bar 16 to push them out of the flutes 18 in the rolling drum 14. Such pressure may be accommodated by components which are deformable and/or resilient. However, if components are delicate, fragile, or brittle, then the components may be damaged, broken, or deformed by the pressure applied to the components. For example, a plastic component may be cracked or broken by the pressure. Furthermore, if the kicker bar 16 and/or roll hand 15 are set further away from the rolling drum to avoid damaging the harder components, the kicker bar 16 may not exert sufficient force to push the tobacco rods 5 and other filter components 6 out of the flutes 18 or roll them between the rolling drum surface 17 and roll hand 15 successfully or reliably. Yet further, passing hard rigid components between a fixed kicker bar 16 and roll hand 15 unit, and the rolling drum 14 of a conventional apparatus, may force the roll hand 15 away from the rolling drum 14, enlarging the spacing therebetween. As mentioned above, the clearance between the roll hand 15 and the curved surface 17 of the rolling drum 14 is carefully set, and effective and reliable operation of the apparatus 1 is sensitive to this spacing. Therefore, unintentional enlargement of this spacing can be detrimental to the operation of the apparatus 1, for example, ineffective rolling of the filter component 6 and tobacco rod 5 with the tipping paper patch 22, or these components falling out of the gap between the rolling drum 14 and the roll hand 15.

In order to seek to avoid or mitigate the above problems and to accommodate smoking article components of a differing hardnesses, the roll hand 15 and kicker bar 16 of an exemplary embodiment of the present invention are provided as illustrated in more detail in FIGS. 4 to 6B.

The roll hand 15 includes a curved contact surface 31 which, in use, faces the rolling drum 14 and presses against the tobacco rods 5 and filter components 6 as they are rolled between the roll hand 15 and the rotating rolling drum 14 to become wrapped with the tipping paper patch 22. The kicker bar 16 includes a contact edge 32 which, in use, is disposed closest to the rolling drum 14. The distance between the contact edge 32 and the rolling drum 14 affects how the tobacco rods 5 and filter components 6 are initially compressed and/or pushed out of the flutes 18.

The kicker bar 16 is provided on a mounting mechanism 33 which is configured to enable the kicker bar 16 to move in a direction towards and away from the rolling drum 14, as indicated by arrow 'A' in FIGS. 4 to 6B. The mounting mechanism 33 comprises a mounting bracket 34 which is fixedly secured to the rear surface of the roll hand 15 opposite to the contact surface 31. The mounting bracket 34 includes a plate 35 which extends beyond an edge of the roll hand 15 adjacent the kicker bar 16. The kicker bar 16 includes a flange 36 projecting from an edge of the kicker bar 16 remote from the contact edge 32. A pair of rods 37 extend between the plate 35 and the flange 36, each rod 37 includes a first end fixed to the flange 36 and second, opposite end slidably connected to the plate 35. Each rod 37 may, for example, be received in a hole in the plate 35. The rods 37 may be connected to the flange 36 and plate 35 by suitable known mechanical fastening means, such as threaded nuts on a threaded shaft, welding or bonding (for the fixed connection to the flange 36). A biasing mechanism is provided and is configured to bias the flange 36 away from the plate 35, and thereby bias the kicker bar 16 towards the rolling drum 14. In the exemplary embodiment shown, the biasing mechanism comprises biasing members 38 provided around the rods 37. In the embodiment shown, the biasing members 38 comprise springs 38. However, other numbers or types of biasing members, means or mechanisms are intended within the scope of the invention, such as other forms of springs, pneumatic or hydraulic pistons, or a resilient material disposed between the plate 35 and the flange 36.

The kicker bar 16 is slidably attached to the roll hand 15. In the exemplary embodiment shown, the kicker bar 16 is a slidably secured to the roll hand 15 by mechanical fasteners 39, such as screws, pins or bolts. The kicker bar 16 includes slots 40 through which a shaft portion (not shown) of the mechanical fasteners 39 extend. The mechanical fasteners 39 do not clamp the kicker bar 16 tightly to the roll hand 15 because this would prevent the kicker bar 16 being moveable relative to the roll hand 15. Instead, the mechanical fasteners 39 are sufficiently loose for the kicker bar 16 to move relative to the roll hand 15 by the mechanical fasteners 39 moving within the respective slot 40.

Figure 4:
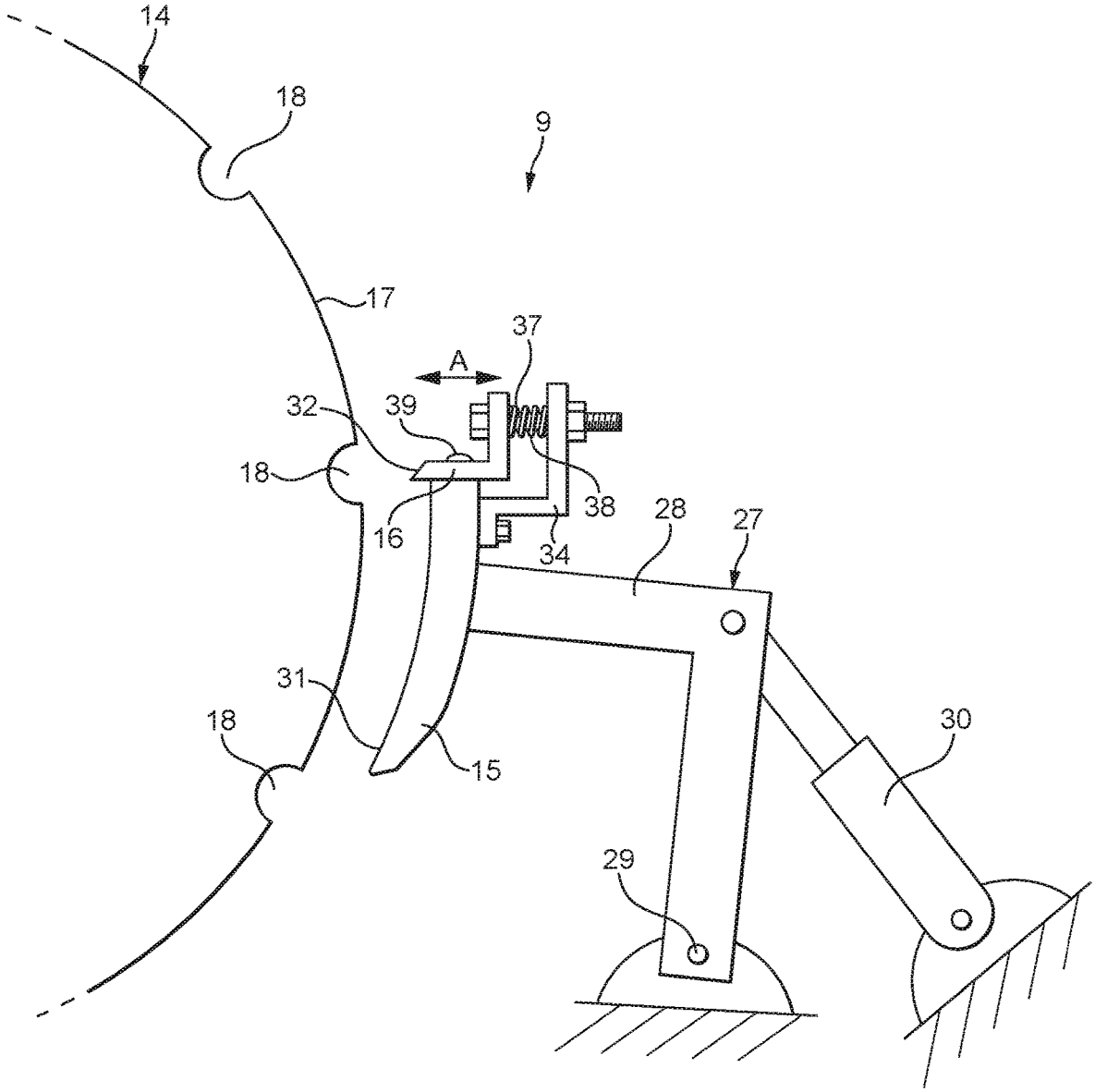
FIG. 4 shows an enlarged view of a rolling unit of the apparatus of FIG. 1.
Figure 5:
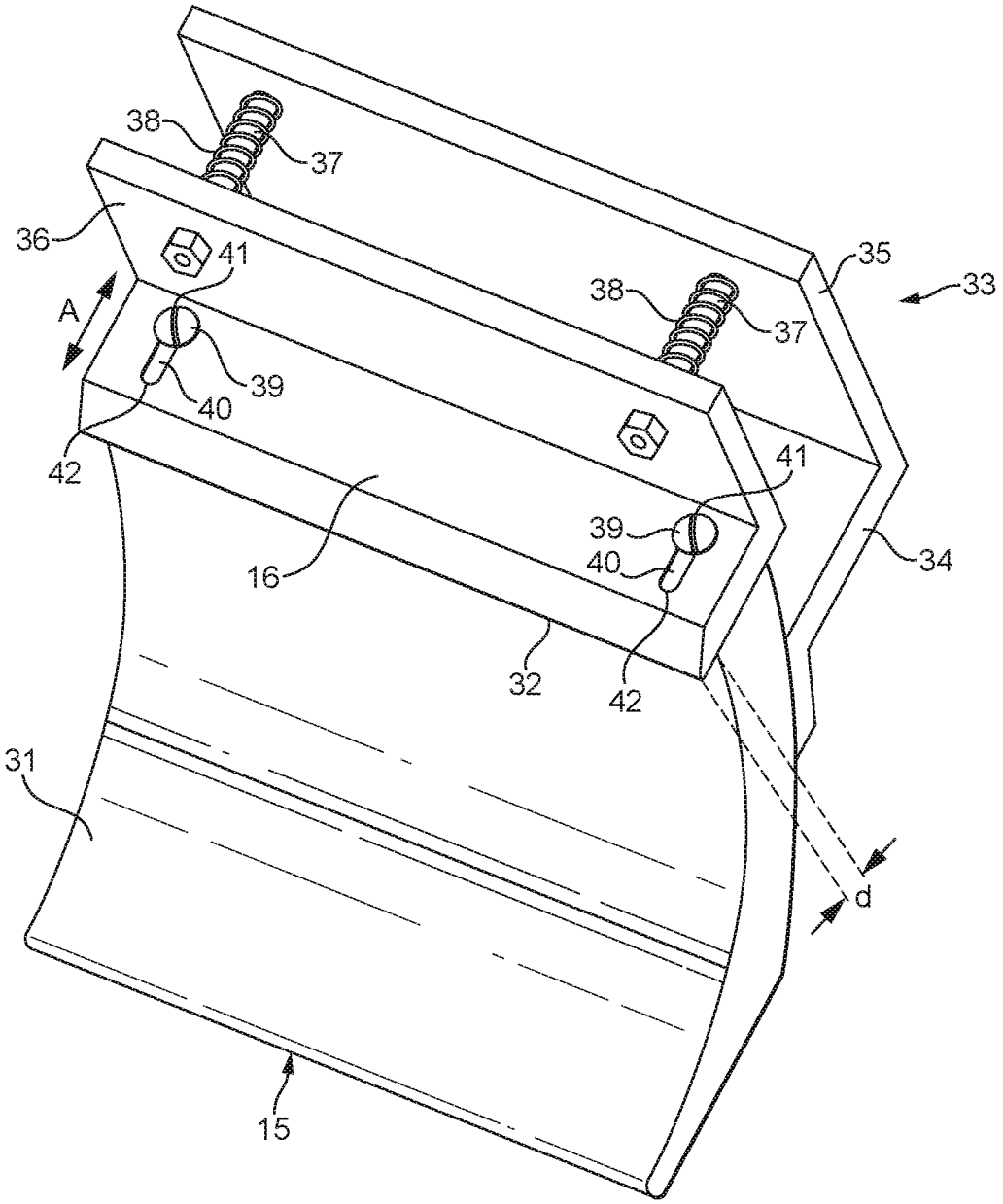
FIG. 5 shows an enlarged view of a roll hand and kicker bar of the rolling unit of FIG. 4.
Figure 6A:
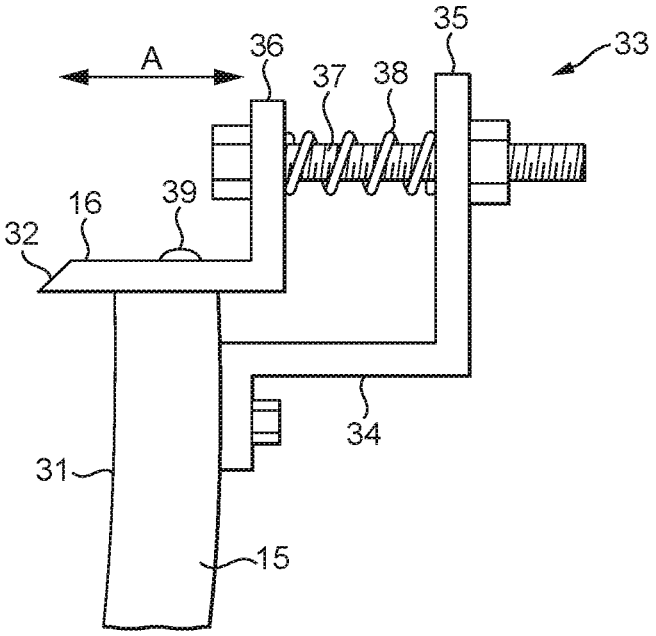
FIG. 6A shows an enlarged view of the kicker bar and mounting mechanism shown in FIGS. 4 and 5 in a first, extended position.
Figure 6B:
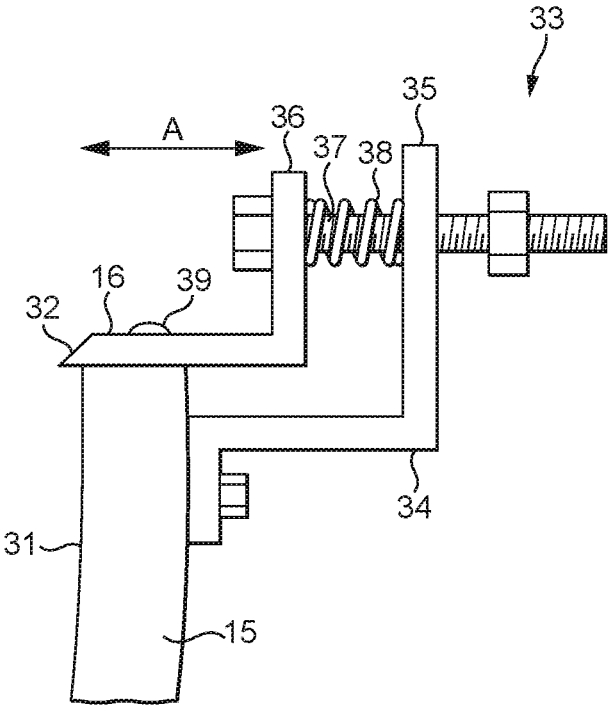
FIG. 6B shows the kicker bar and mounting mechanism shown in FIG. 6A in a second, deflected position.

The kicker bar 16 is moveable between a first, extended position (as shown in FIGS. 4, 5 and 6A) and a second, deflected position (shown in FIG. 6B). The biasing members 38 urge the kicker bar 16 into the first, extended position. In an embodiment, the sliding range of movement of the kicker bar 16 may be defined and limited by the slot 40. In such an exemplary embodiment, in the first, extended position, the kicker bar 16 is positioned closest to the rolling drum 14 and the mechanical fasteners 39 are disposed at a first distal end 41 of the respective slot 40. Said first distal end 41 of the slot 40 being the end proximate the flange 36. In the second, deflected position, the kicker bar 16 is further away from the rolling drum 14 than in the first position and the mechanical fasteners 39 are disposed away from the first distal end 41 of the respective slot 40. Again, the extent to which the kicker bar 16 can be deflected away from the first extended position may be determined by the slot 40. In such an embodiment, the kicker bar 16 may only be deflected away from the first extended position by a distance equal to the length of the slot 40. Accordingly, the kicker bar 16 can be moveable to a fully deflected position in which the mechanical fasteners 39 are disposed at a second distal end 42 of the respective slot 40.

Operation of the rolling unit 9 of the apparatus 1 of one embodiment of the invention will now be described, with reference to FIGS. 1 to 6B and also FIG. 10. The tobacco rods 5 and filter components 6, together with the tipping paper patch 22, are transferred from the tipping drum 8 to the rolling drum 14 in step S1, as described above. The tobacco rods 5 and filter components 6 reach and engage the kicker bar 16 as the rolling drum 14 rotates, at step S2. One of the filter components 6 (second segment 25) comprises a tubular member made from plastic having a high hardness, relative to the more compressible tobacco rod 5, first filter segment 24 made of plasticized cellulose acetate and third filter segment 26 made of paper. The filter components 6 contact the contact edge 32 of the kicker bar 16. Pressure is exerted on the tobacco rod 5 and filter components 6 to compress them and push them out of the flute 18 as described above. However, the second segment 25 is less compressible than the remaining components. Therefore, instead of the kicker bar 16 damaging the second segment 25, or the roll hand 15 getting nudged away from the rolling drum 14 and so becoming misaligned, the kicker bar 16 is deflected away from the rolling drum 14 against the biasing force of the biasing members 38, at step S3. This deflection is sufficient to accommodate the second segment 25 and prevent damage thereto. However, the kicker bar 16, under the force of the biasing members 38, still provides sufficient compressive force for the tobacco rods 5 and filter components 6 to be pushed out of the flute 18 at step S4. Thereafter, the tobacco rods 5 and filter components 6, together with the tipping paper patch 22, pass the kicker bar 16 and are rolled between the curved outer surface 17 of the rolling drum 14 and the curved contact surface 31 of the roll hand 15 as described previously, at step S5.

Thereafter, the rolled smoking articles, comprising the rolled tobacco rods 5 and filter components 6 surrounded by tipping paper patch 22, are conveyed by further drums for cutting into individual single length smoking articles, aligning, arranging and packaging in a known manner.

Figure 7A:
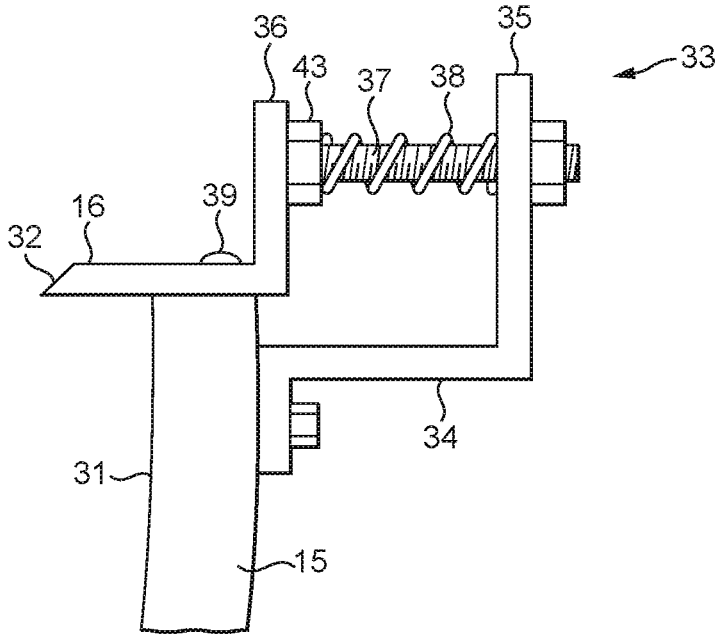
FIG. 7A shows an enlarged view of a kicker bar and mounting mechanism of a first alternative embodiment, in an extended position and with a first biasing force adjustment setting.
Figure 7B:
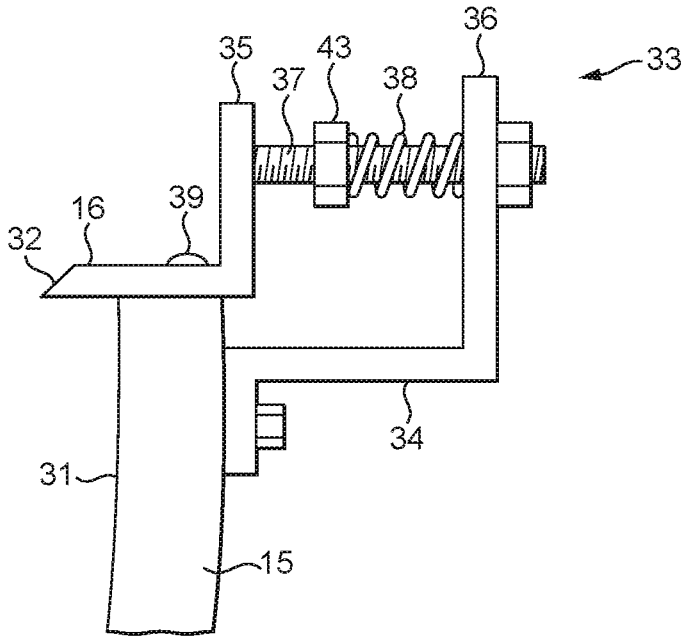
FIG. 7B shows an enlarged view of the kicker bar and mounting mechanism shown in FIG. 7A in an extended position and with a second biasing force adjustment setting.

It is intended within the scope of the invention that the biasing force with which the kicker bar 16 is biased towards the rolling drum 14, may be adjustable. A first alternative exemplary embodiment which comprises a biasing mechanism that enables such adjustment of the biasing force is shown in FIGS. 7A and 7B, in which like features with the mounting mechanism 33 shown in FIGS. 6A and 6B retain the same reference numerals. In the first alternative embodiment shown in FIGS. 7A and 7B, the rods 37 are threaded along their length, and a nut 43 is provided on each rod 37 between the plate 35 and the flange 36. In the exemplary embodiment shown in FIGS. 7A and 7B, the first end of each rod 37 is fixed to the flange 36 by welding or bonding, as an example of one securing means within the scope of the invention. The nuts 43 can be adjusted to move along the respective rod 37 to increase or decrease the pre-load on the springs 38, thereby increasing or decreasing the force required to deflect the kicker bar 16. In FIG. 7A, the nut 43 is positioned to achieve the least pre-load and minimum biasing force. In FIG. 7B, the nut 43 is positioned to achieve an increased spring pre-load and thereby increased biasing force.

Although one exemplary adjustable biasing mechanism is described above, other means of biasing force adjustment are intended within the scope of the invention, for example, an adjustable friction mechanism, additional spring members that may be introduced or removed from the mechanism, alternative spring members with different spring rates/biasing forces may be substituted, adjustable dampers or adjustable gas pressure pneumatic piston(s).

Figure 8A:
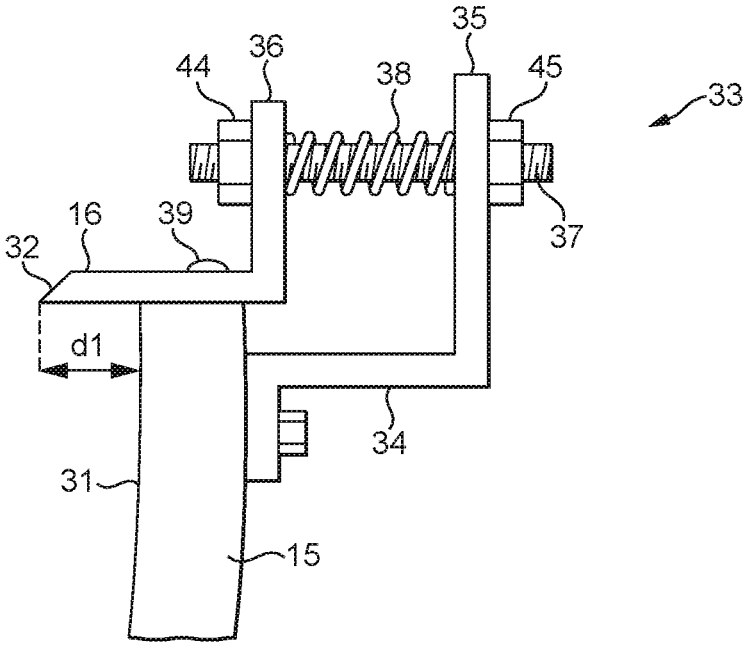
FIG. 8A shows an enlarged view of a kicker bar and mounting mechanism of a second alternative embodiment, in an extended position with a first off-set setting.
Figure 8B:
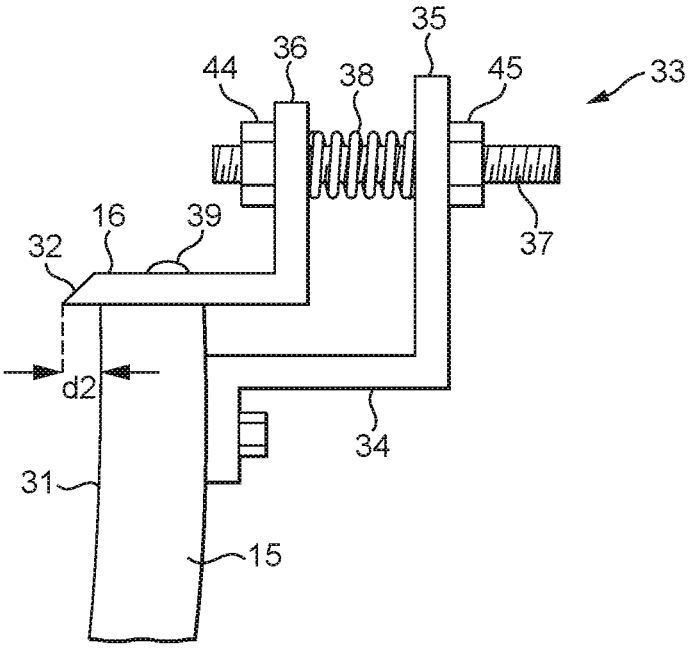
FIG. 8B shows an enlarged view of the kicker bar and mounting mechanism shown in FIG. 8A in an extended position and with a second off-set setting.
Figure 9:
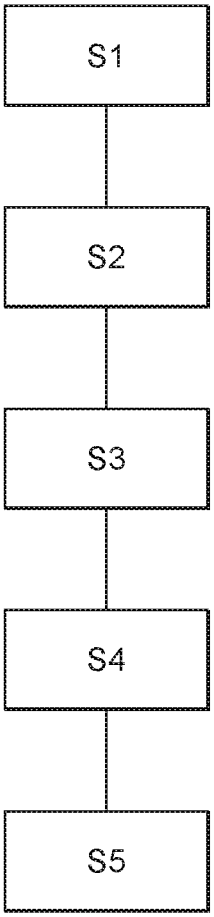
FIG. 9 shows a flow chart illustrating a method of operation of a tobacco industry product manufacturing apparatus of an embodiment of the invention.

It is intended within the scope of the invention that the kicker bar 16 may be adjustable relative to the roll hand 15. That is, an off-set (see distance 'd' in FIG. 5) of the contact edge 32 of the kicker bar 16 from the curved contact surface 31 of the roll hand 15, when the kicker bar 16 is in the first, extended position, can be adjusted and set. This may be by the provision of an adjustment mechanism, and the mounting mechanism 33 may comprise such adjustment mechanism. This adjustment may be desirable to accommodate filter components 6 of differing hardnesses. A second alternative exemplary embodiment with adjustable kicker bar 16 off-set 'd' is shown in FIGS. 8A and 8B, in which like features with the mounting mechanism 33 shown in FIGS. 6A to 7B retain the same reference numerals. In the second alternative embodiment shown in FIGS. 8A and 8B, the rods 37 are threaded along their length, and first and second nuts 44, 45 are respectively provided proximate first and second distal ends of each rod 37. The first and second nuts 44, 45 are provided on the outside of the flange 36 and the plate 35 respectively. In the exemplary embodiment shown in FIGS. 8A and 8B, the first end of each rod 37 is fixed to the flange 36 by said first nut 44, as an example of one securing means within the scope of the invention. One or both of the first and second nuts 44, 45 can be adjusted to move along the respective rod 37. This increases or decreases the distance between the plate 35 and the flange 36 and, since the plate 35 is fixed relative to the roll hand 15, thereby increases or decreases the off-set 'd' between the contact edge 32 of the kicker bar 16 and the curved contact surface 31 of the roll hand 15.

In FIG. 8A, the second nut 45 is positioned to achieve a first off-set distance 'd1'. In FIG. 8B, the second nut 45 is positioned to achieve a second off-set distance 'd2' which is less than the first off-set distance 'd1'. It will be appreciated that either the first, or second, or both nuts 44, 45 may be adjusted to adjust the off-set distance 'd'. It is also intended therefore, within the scope of the invention, that one end of each rod 37 may be fixedly secured to the respective plate 35 or flange 36, while the other end of each rod 37 is slidable within the other of the plate 35 and flange 36. In such an embodiment, an off-set adjustment nut would only be provided on one end of each rod 37, that is the end that is slidable with respect to the respective plate 35 or flange 36.

As mentioned above, alternative spring members 38 may be substituted, if necessary, to ensure the biasing force provided by the biasing members 38 is at a desired level for a given off-set 'd' setting (since different off-set settings would result in different pre-loads on the spring members 38).

It will be appreciated that the maximum off-set distance 'd' is limited by the mechanical fasteners 39 abutting the first distal end 41 of the respective slot 40. Smaller off-set distance 'd' settings are determined by the first and/or second nuts 44, 45 abutting the flange 36 and/or plate 35 respectively.

In a further alternative embodiment intended within the scope of the invention, the range of movement of the kicker bar 16, and the extended and fully deflected positions, may be adjusted using shims or other suitable spacers or filler elements which may be inserted in the slots 40 to adjust the slot 40 length and effectively adjust the position of the first and/or second distal ends 41, 42 of the slots 40. Furthermore, a ring (not shown) may be provided threaded on the rods 37 between the plate 35 and flange 36, and within the circumference of the biasing springs 38 so as not to interfere with the biasing springs 38. The ring may be moved along the rods 37 and positioned to define the fully deflected position of the kicker bar 16. In such a position, the ring would abut the plate 35 or flange 36, whichever move relative to the rods 37. In other words, the rings would define the minimum spacing permitted between the plate 35 and the flange 36 as the kicker bar 16 is deflected.

In the exemplary embodiments described above, the kicker bar 16 is moveably mounted to the roll hand 15 by mechanical fasteners. However, the invention is not intended to be limited to this configuration of rolling unit 9 and alternative configurations are envisaged within the scope of the invention. For example, the kicker bar may be mounted adjacent to the roll hand 15 but not connected to the roll hand by the mechanical fasteners 39 shown. For example, the mechanical fasteners may be omitted and the mounting mechanism 33 may entirely support the kicker bar 16 and determine its range of movement. Yet further, the mounting mechanism 33 may not be fixedly secured to the rear surface of the roll hand 15 but instead may be secured to another part of the apparatus for manufacture of tobacco industry products. In such alternative embodiment intended within the scope of the invention, the kicker bar 16 would still be moveable relative to roll hand 15 and to the rolling drum 14.

In the exemplary embodiments described above, movement of the kicker bar maybe adjusted by one or more nuts 43, 44, 45 on threaded rods 37. However, the invention is not intended to be limited to this configuration and alternative configurations are envisaged within the scope of the invention. For example, the rods 37 may include clamps, clips, C-rings, or other elements fixable thereto to achieve the same or similar effect.

In the exemplary embodiments described above, the mounting mechanism 33 is configured such that the kicker bar 16 is able to move linearly towards and away from the rolling drum 14. However, the invention is not intended to be limited to this configuration of mounting mechanism 33, and alternative mounting mechanisms are envisaged within the scope of the invention. For example, the kicker bar 16 may be pivoted to move relative to the rolling drum 14 in an arcuate path.

As used herein, the term "tobacco industry products" is intended to include smoking articles comprising combustible smoking articles such as cigarettes, cigarillos, cigars, tobacco for pipes or for roll-your-own cigarettes, (whether based on tobacco, tobacco derivatives, expanded tobacco, reconstituted tobacco, tobacco substitutes or other smokable material), electronic smoking articles such as e-cigarettes, heating devices that release compounds from substrate materials without burning such as tobacco heating products, hybrid systems to generate aerosol from a combination of substrate materials, for example hybrid systems containing a liquid or gel or solid substrate; and aerosol-free nicotine delivery articles such as lozenges, gums, patches, articles comprising breathable powders and smokeless tobacco products such as snus and snuff.

In one example, the apparatus for manufacture of tobacco industry products described previously is used to make a tobacco industry product that is a smoking article for combustion, selected from the group consisting of a cigarette, a cigarillo and a cigar.

In another example, the apparatus is used to make a tobacco industry product that is a non-combustible smoking article.

In another example, the apparatus is used to make tobacco industry product that is a heating device which releases compounds by heating, but not burning, a substrate material. The material may be for example tobacco or other non-tobacco products, which may or may not contain nicotine. In one embodiment the heating device is a tobacco heating device. The apparatus may alternatively be used to make a consumable for a heating device.

In another embodiment the apparatus is used to make a tobacco industry product that is a hybrid system to generate aerosol by heating, but not burning, a combination of substrate materials. The substrate materials may comprise for example solid, liquid or gel which may or may not contain nicotine. In one embodiment, the hybrid system comprises a liquid or gel substrate and a solid substrate. The solid substrate may be for example tobacco or other non-tobacco products, which may or may not contain nicotine. In one embodiment the hybrid system comprises a liquid or gel substrate and tobacco.

The drawings accompanying the various embodiments of the invention described herein are not necessarily illustrated to scale and the dimensions of certain features may be exaggerated for ease and clarity of illustration.

In order to address various issues and advance the art, the entirety of this disclosure shows by way of illustration various embodiments in which the claimed invention(s) may be practiced and provide for a superior tobacco industry product manufacturing apparatus. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. An apparatus for manufacture of tobacco industry products, the apparatus comprising a rolling unit comprising:

a rotatable drum having a plurality of recesses formed in an outer surface of the drum to receive tobacco industry product components;

a roll hand spaced from the outer surface of the drum to define a space between the outer surface of the drum and the roll hand, within which space tobacco industry product components are rollable upon rotation of the drum; and a kicker bar disposed adjacent to the roll hand;

wherein the kicker bar is moveable relative to the roll hand and in a direction towards and away from the drum during operation of the apparatus;

wherein the kicker bar is biased towards the drum;

wherein the kicker bar is moveable between an extended position in which a contact edge of the kicker bar is spaced from the drum by a first distance, and a deflected position in which the kicker bar is spaced from the drum by a second distance greater than the first distance, wherein the kicker bar is biased into the extended position; and wherein the position of the kicker bar relative to the roll hand, while the kicker bar is maintained in the extended position, is adjustable.

2. An apparatus according to claim 1 wherein the kicker bar is deflectable away from the drum by contact with tobacco industry product components received in the drum recesses during rotation of the drum.

3. An apparatus according to claim 1, wherein the kicker bar is coupled to the roll hand.

4. An apparatus according to claim 1, wherein the roll hand comprises a curved contact surface facing the drum, and wherein the contact edge of the kicker bar is disposed closer to the drum than the contact surface of the roll hand in at least the extended position of the kicker bar.

5. An apparatus according to claim 1, wherein the kicker bar is connected to a mounting mechanism comprising a mounting bracket, wherein the mounting mechanism is configured to enable the kicker bar to move relative to the mounting bracket and towards and away from the rolling drum.

6. An apparatus according to claim 5 wherein the mounting mechanism comprises a biasing mechanism configured to bias the kicker bar towards the drum.

7. An apparatus according to claim 6, wherein the biasing mechanism is adjustable such that biasing force with which the kicker bar is biased towards the drum is adjustable.

8. An apparatus according to claim 7 wherein the biasing mechanism comprises a spring, and a pre-load of the spring is adjustable.

9. An apparatus according to claim 1, wherein the kicker bar is moveable linearly towards and away from the drum.

10. An apparatus according to claim 1, wherein the kicker bar is pivotable towards and away from the drum.

11. A tobacco industry product assembly machine comprising an apparatus according to claim 1.

* * * * *